US007234539B2

(12) United States Patent
Wright et al.

(10) Patent No.: US 7,234,539 B2
(45) Date of Patent: Jun. 26, 2007

(54) METHOD AND APPARATUS FOR RESCALING MEASUREMENTS WHILE DRILLING IN DIFFERENT ENVIRONMENTS

(75) Inventors: Eric Wright, Ellon (GB); James Frederick Brosnahan, Houston, TX (US); Greg Allen Neubauer, Houston, TX (US)

(73) Assignee: Gyrodata, Incorporated, Houston, TX (US)

( * ) Notice: Subject to any disclaimer, the term of this patent is extended or adjusted under 35 U.S.C. 154(b) by 150 days.

(21) Appl. No.: 10/840,666

(22) Filed: May 6, 2004

(65) Prior Publication Data

US 2005/0155794 A1 Jul. 21, 2005

Related U.S. Application Data

(60) Provisional application No. 60/486,202, filed on Jul. 10, 2003.

(51) Int. Cl.
*E21B 7/00* (2006.01)

(52) U.S. Cl. ..... 175/45

(58) Field of Classification Search ..... 175/45; 702/9, 10, 150; 703/10
See application file for complete search history.

(56) References Cited

U.S. PATENT DOCUMENTS

| | | | |
|---|---|---|---|
| 4,537,067 | A | 8/1985 | Sharp et al. |
| 4,909,336 | A | 3/1990 | Brown et al. |
| 4,987,684 | A | 1/1991 | Andreas et al. |
| 5,099,927 | A | 3/1992 | Gibson et al. |
| 5,432,699 | A | 7/1995 | Hache et al. |
| 5,657,547 | A | 8/1997 | Uttecht et al. |
| 5,806,195 | A | 9/1998 | Uttecht et al. |
| 5,812,068 | A | 9/1998 | Wisler et al. |
| 5,821,414 | A | 10/1998 | Noy et al. |
| 5,842,149 | A | 11/1998 | Harrell et al. |
| 6,021,377 | A | 2/2000 | Dubinsky et al. |
| 6,145,378 | A | 11/2000 | MacRobbie et al. |
| 6,173,773 | B1 | 1/2001 | Almaguer et al. |

(Continued)

FOREIGN PATENT DOCUMENTS

| | | |
|---|---|---|
| EP | 646 696 A1 | 9/1994 |

(Continued)

OTHER PUBLICATIONS

US 6,151,553, 11/2000, Estes et al. (withdrawn)

*Primary Examiner*—Jennifer H. Gay
*Assistant Examiner*—Matthew J. Smith
(74) *Attorney, Agent, or Firm*—Knobbe Martens Olson & Bear LLP

(57) ABSTRACT

A method and apparatus are provided for determining an orientation of a drilling tool of a drilling system configured to drill a borehole into the Earth's surface. The method includes providing a survey system including at least one sensor within the drilling system. The sensor is configured to provide orientation information. The survey system is operable at a plurality of resolution levels. The method further includes operating the survey system at a first resolution level while the drilling tool is a first distance relative to the surface. The method further includes operating the survey system at a second resolution level while the drilling tool is a second distance relative to the surface. The second distance is larger than the first distance. The second resolution level is higher than the first resolution level.

34 Claims, 5 Drawing Sheets

U.S. PATENT DOCUMENTS

| | | | | |
|---|---|---|---|---|
| 6,173,793 | B1 * | 1/2001 | Thompson et al. | 175/45 |
| 6,192,748 | B1 | 2/2001 | Miller | |
| 6,206,108 | B1 | 3/2001 | MacDonald et al. | |
| 6,257,356 | B1 | 7/2001 | Wassell | |
| 6,267,185 | B1 | 7/2001 | Mougel et al. | |
| 6,272,434 | B1 * | 8/2001 | Wisler et al. | 702/9 |
| 6,315,062 | B1 | 11/2001 | Alft et al. | |
| 6,347,282 | B2 | 2/2002 | Estes et al. | |
| 6,381,858 | B1 | 5/2002 | Shirasaka | |
| 6,431,270 | B1 * | 8/2002 | Angle | 175/98 |
| 6,453,239 | B1 | 9/2002 | Shirasaka et al. | |
| 6,484,818 | B2 | 11/2002 | Alft et al. | |
| 6,655,460 | B2 | 12/2003 | Bailey et al. | |
| 6,659,201 | B2 | 12/2003 | Head et al. | |
| 2002/0056201 | A1 | 5/2002 | Dallas et al. | |
| 2002/0112887 | A1 | 8/2002 | Harrison | |

FOREIGN PATENT DOCUMENTS

| | | |
|---|---|---|
| WO | PCT/US2004/021899 | 7/2004 |

* cited by examiner

METHOD AND APPARATUS FOR RESCALING MEASUREMENTS WHILE DRILLING IN DIFFERENT ENVIRONMENTS

CLAIM OF PRIORITY

This application claims benefit from U.S. Provisional patent application No. 60/486,202, filed Jul. 10, 2003, the entirety of which is incorporated by reference herein.

BACKGROUND OF THE INVENTION

1. Field of the Invention

The present application relates generally to systems and methods for determining the position of a directional drilling tool using measurement while drilling.

2. Description of the Related Art

Directional drilling for the exploration of oil and gas deposits advantageously provides the capability of generating boreholes which deviate significantly relative to the vertical direction (that is, perpendicular to the Earth's surface) by various angles and extents. In certain circumstances, directional drilling is used to provide a borehole which avoids faults or other subterranean structures (e.g., salt dome structures). Directional drilling is also used to extend the yield of previously-drilled wells by reentering and milling through the side of the previously-drilled well, and drilling a new borehole directed so as to follow the hydrocarbon-producing formation. Directional drilling can also be used-to provide numerous boreholes beginning from a common region, each with a shallow vertical portion, an angled portion extending away from the common region, and a termination portion which can be vertical. This use of directional drilling is especially useful for offshore drilling, where the boreholes are drilled from the common region of a centrally positioned drilling platform.

Directional drilling is also used in the context of horizontal directional drilling ("HDD") in which a pathway is drilled for utility lines for water, electricity, gas, telephone, and cable conduits. Exemplary HDD systems are described by Alft et al. in U.S. Pat. Nos. 6,315,062 and 6,484,818. Such HDD systems typically drill along relatively short distances substantially horizontal to the surface and do not drill very far below the surface.

The pathway of a directionally drilled borehole is typically carefully planned prior to drilling, and the position and direction of the drilling tool is repeatedly determined during the drilling process using surveys to map the pathway relative to a fixed set of known coordinates. In wireline surveys, the drilling of the borehole is periodically halted and a survey tool is lowered into the borehole. In some instances, the drilling assembly (i.e., the drilling tool and the drill string) is removed from the borehole so that the survey tool can be lowered into the borehole, while in other instances, the survey tool is inserted into the drilling assembly itself. As the survey tool is guided along the borehole, it provides information regarding its orientation and location by sending signals through a cable to the surface. This information is then used to determine the pathway of the borehole. The survey tool is then removed from the borehole and, in instances in which the drilling assembly had been removed from the borehole, the drilling assembly is returned to the borehole to continue drilling. Such wireline surveys thus require extensive time and effort to repeatedly stop drilling, insert the survey tool into the borehole, and remove the survey tool from the borehole. Since the costs associated with operation of a drilling system can be quite high, any time reductions in borehole surveying can result in substantial cost savings.

In so-called "measurement while drilling" ("MWD") surveys, the MWD survey tool is a component of the drilling assembly, typically in proximity to the drilling tool, and it remains within the borehole throughout the drilling process. MWD survey measurements of the orientation and location of the MWD survey tool are made without removing the drilling assembly from the borehole. Typically, MWD survey measurements are taken during periods in which additional drill pipes are connected to extend the drill string and the drilling assembly is substantially stationary, which takes approximately one to two minutes to a few minutes. Use of MWD surveys saves time during operation of the drilling system by eliminating the need to remove and replace the survey tool in order to survey the pathway of the borehole.

SUMMARY OF THE INVENTION

In certain embodiments, a method is provided for determining an orientation of a drilling tool of a drilling system configured to drill a borehole into the Earth's surface. The method comprises providing a survey system comprising at least one sensor within the drilling system. The sensor is configured to provide orientation information. The survey system is operable at a plurality of resolution levels. The method further comprises operating the survey system at a first resolution level while the drilling tool is a first distance relative to the surface. The method further comprises operating the survey system at a second resolution level while the drilling tool is a second distance relative to the surface. The second distance is larger than the first distance. The second resolution level is higher than the first resolution level.

In certain embodiments, a method is provided for determining a location of a drilling tool of a drilling system configured to drill a borehole into the Earth's surface. The method comprises providing a survey system comprising at least one sensor within the drilling system. The sensor is configured to provide location information. The survey system is operable at a plurality of resolution levels. The method further comprises operating the survey system at a first resolution level while the drilling tool is a first distance relative to the surface. The method further comprises operating the survey system at a second resolution level while the drilling tool is a second distance relative to the surface. The second distance is larger than the first distance. The second resolution level is higher than the first resolution level.

In certain embodiments, a method is provided for determining either an orientation or a location of a drilling tool of a drilling system configured to drill a borehole into the Earth's surface. The method comprises providing a survey system comprising at least one sensor within the drilling system. The sensor is configured to provide orientation information. The survey system is operable at a plurality of resolution levels. The method further comprises operating the survey system at a first resolution level while the drilling tool is at a first location relative to the surface. The method further comprises operating the survey system at a second resolution level while the drilling tool is at a second location relative to the surface. The second location is farther from the surface than is the first location. The second resolution level is higher than the first resolution level. The method further comprises calculating the orientation or the location of the drilling tool using the orientation information.

In certain embodiments, a method is provided for operating a sensor of a system for drilling a borehole. The method comprises configuring the sensor to provide orientation information having a first resolution level while at a first position relative to a surface location. The method further comprises configuring the sensor to provide orientation information having a second resolution level higher than the first resolution level while at a second position relative to the surface location.

In certain embodiments, a method is provided for operating a sensor of a drilling system comprising a drill string. The method comprises configuring the sensor to provide orientation information having a first resolution level while the drill string has a length less than a predetermined length. The method further comprises configuring the sensor to provide orientation information having a second resolution level higher than the first resolution level while the drill string has a length greater than the predetermined length.

In certain embodiments, a drilling system is provided for drilling a borehole into the Earth's surface. The system comprises a drilling tool and a survey system configured to be operable at a plurality of resolution levels. The survey system comprises at least one sensor within the drilling system. The sensor is configured to provide orientation information. The survey system further comprises a controller coupled to the sensor. The controller is configured to operate at a first resolution level while the drilling tool is a first distance relative to the surface and to operate at a second resolution level while the drilling tool is a second distance relative to the surface. The second distance is larger than the first distance. The second resolution level is higher than the first resolution level.

For purposes of summarizing the invention, certain aspects, advantages and novel features of the invention have been described herein above. It is to be understood, however, that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENT

The accuracy and resolution of MWD borehole surveys are affected by various contributions dependent on the type of sensors used to determine the orientation of the MWD survey tool. Magnetic survey instrumentation utilizes magnetometers to detect the magnitude and direction of the Earth's magnetic field relative to the orientation and position of the MWD survey tool. The accuracy of such magnetic measurements is influenced by various effects such as: day-to-day changes in the Earth's magnetic field and localized distortions or contributions to the magnetic field from nearby ferrous deposits or materials (e.g., steel casings of adjacent boreholes, the drilling assembly itself, iron ore deposits). In addition, the accuracy and resolution of magnetic measurements can be influenced by undesired movements of the MWD survey tool.

Other survey instrumentations utilize accelerometers to measure the direction to the center of the Earth, and rate gyroscopes to measure the direction of the Earth's rotational axis. Various configurations of accelerometers and rate gyroscopes can then provide measurements for mapping the pathway of the borehole. As with magnetic measurements, the accuracy and resolution of accelerometer and gyroscopic measurements can be influenced by undesired movements of the MWD survey tool. In addition such measurements are influenced by undesired accelerating forces on the MWD survey tool.

Such movements and accelerating forces can be generated, for example, on an offshore drilling platform buffeted by ocean waves. Motions of the drilling platform can be imparted to the MWD survey tool, thereby providing a source of noise to the data signals generated by the MWD survey tool. This signal noise hinders the accuracy of the resulting calculations of the orientation and/or location of the MWD drilling tool. For example, for gyroscopic sensors sensitive to the Earth's rotation, the magnitude of this signal noise can be much larger than the expected signal due to the Earth's rotation vector, which is relatively small and difficult to detect. The magnitude of the signal noise is typically largest in an environment near the surface (e.g., either above the surface or at relatively shallow depths below the surface). As the drilling tool progresses to environments further down from the surface, the noise is attenuated, thereby facilitating more accurate calculations of the orientation and/or location of the MWD drilling tool.

It is desirable to perform the MWD borehole surveys with sufficient accuracy and resolution throughout the pathway of the borehole to ensure that the drilling assembly is directed in an optimum fashion to predetermined locations. Certain embodiments as described herein provide a method for providing survey borehole pathway measurements that provide sufficient accuracy and resolution.

Figure 1A:
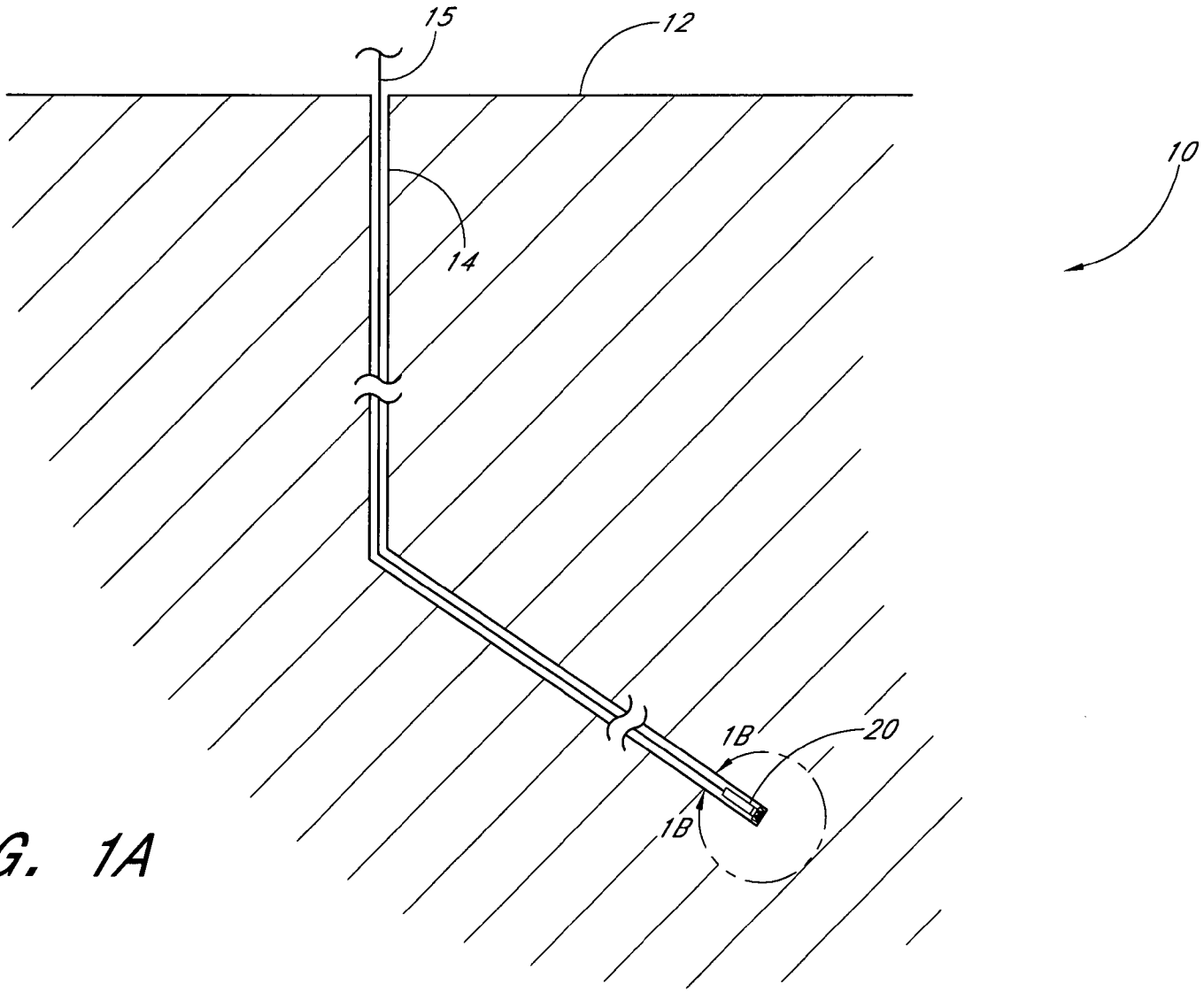
FIGS. 1A and 1B schematically illustrate a drilling system and a drilling tool compatible with embodiments described herein.
Figure 1B:
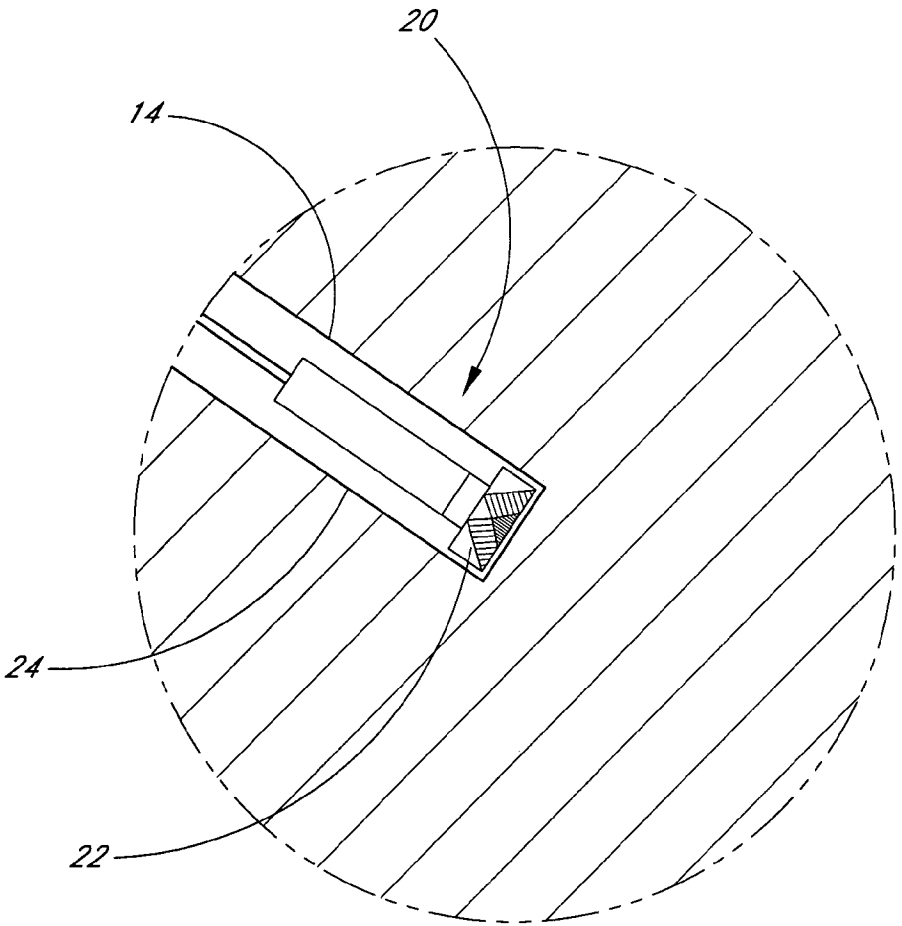

FIGS. 1A and 1B schematically illustrate a MWD drilling system 10 compatible with embodiments described herein extending below the surface 12 along a borehole 14. The drilling system 10 comprises a drill string 15 and a drilling tool 20 comprising a drill bit 22 and a MWD survey tool 24. While the MWD survey tool 24 is shown in FIG. 1B as being adjacent to the drill bit 22, in other embodiments, the MWD survey tool 24 is spaced away from the drill bit 22. In certain such embodiments, a length of drill string 15 can be interposed between the MWD survey tool 24 and the other components of the drilling tool 20. Drilling systems 10 compatible with embodiments described herein are commonly known in the industry.

As schematically illustrated by FIG. 1A, the borehole 14 has a substantially vertical section near the surface 12 and a section which deviates from the vertical direction further below the surface 12 (i.e., has a non-zero inclination angle relative to the vertical direction). In certain embodiments, the drill string 15 comprises a plurality of coupled pipe sections which extend from a drilling platform (not shown). The drill bit 22 is at the end of the drill string 15. As the drill bit 22 progresses below the surface 12, the drill string 15 is lengthened by adding additional drill pipes.

Pressurized drilling fluid ("mud") typically is pumped from above the surface through the drill string 15 to the drill bit 22, where it is discharged and returns to the surface through the annular space between the drill string 15 and the walls of the borehole 14. The drilling fluid carries with it the drill cuttings produced by the drill bit 22. As described herein, the drilling fluid within the drill string 15 can also serve as a conduit of signals and/or power from above the surface 12 to the drilling tool 20.

By rotating the drill bit 22 and applying a forward force, the drill bit 22 is propelled forward to drill into the geological formation, thereby extending the borehole 14. In certain embodiments, the drill bit 22 is rotated by rotating the drill string 15. In other embodiments, the drilling tool 20 comprises a motor powered by flow of the drilling fluid to rotate the drill bit 22.

In certain embodiments, the MWD survey tool 24 comprises a gyroscopic sensor configured to provide a data signal indicative of the orientation of the MWD survey tool 24 relative to the rotation axis of the Earth. In certain such embodiments, the gyroscopic sensor is a rate gyroscope comprising a spinning gyroscope, typically with the spin axis substantially parallel to the borehole 14. The spinning gyroscope undergoes precession as a consequence of the Earth's rotation. The rate gyroscope is configured to detect the components of this precession and to generate a corresponding data signal indicative of the orientation of the rate gyroscope's spin axis relative to the Earth's axis of rotation. By measuring this orientation relative to the Earth's axis of rotation, the rate gyroscope can determine the orientation of the MWD survey tool 24 relative to true north. Such rate gyroscopes can be used in either a gyrocompass mode while the MWD survey tool 24 is relatively stationary, or a gyrosteering mode while drilling is progressing.

Exemplary gyroscopic sensors compatible with embodiments described herein are described more fully in "Survey Accuracy is Improved by a New, Small OD Gyro," G. W. Uttecht, J. P. deWardt, World Oil, March 1983; U.S. Pat. Nos. 5,65,7547, 5,821,414, and 5,806,195. These references are incorporated in their entireties by reference herein. Other examples of gyroscopic sensors in a MWD environment are described by U.S. Pat. No. 6,347,282, which is incorporated in its entirety by reference herein.

The undesired movements and accelerating forces on the MWD survey tool 24 are typically more pronounced in environments near the surface 12. For example, during offshore drilling, forces and movements due to ocean waves can be transmitted to the MWD survey tool 24 through the drill string 15, resulting in corresponding movements of the MWD survey tool 24. As the distance between the MWD survey tool 24 and the surface 12 increases, the forces near the surface are increasingly damped by various frictional forces along the drill string 15 so that the corresponding movements of the MWD survey tool 24 are lessened in these environments. In addition, torques and forces are applied to the drill string 15 to extend the drill string 15 and propel the drilling tool 20 during the drilling process. Friction and other resistive forces (e.g., from twisting of the drill string 15) on the drill string 15 can result in a build-up of energy associated with these torques and forces within the drill string 15, and this energy can suddenly be released once the resistive force is overcome. These build-ups and releases of energy can occur while operating the MWD survey tool 24, resulting in movements and accelerations of the MWD survey tool 24 which affect its output.

Figure 2:
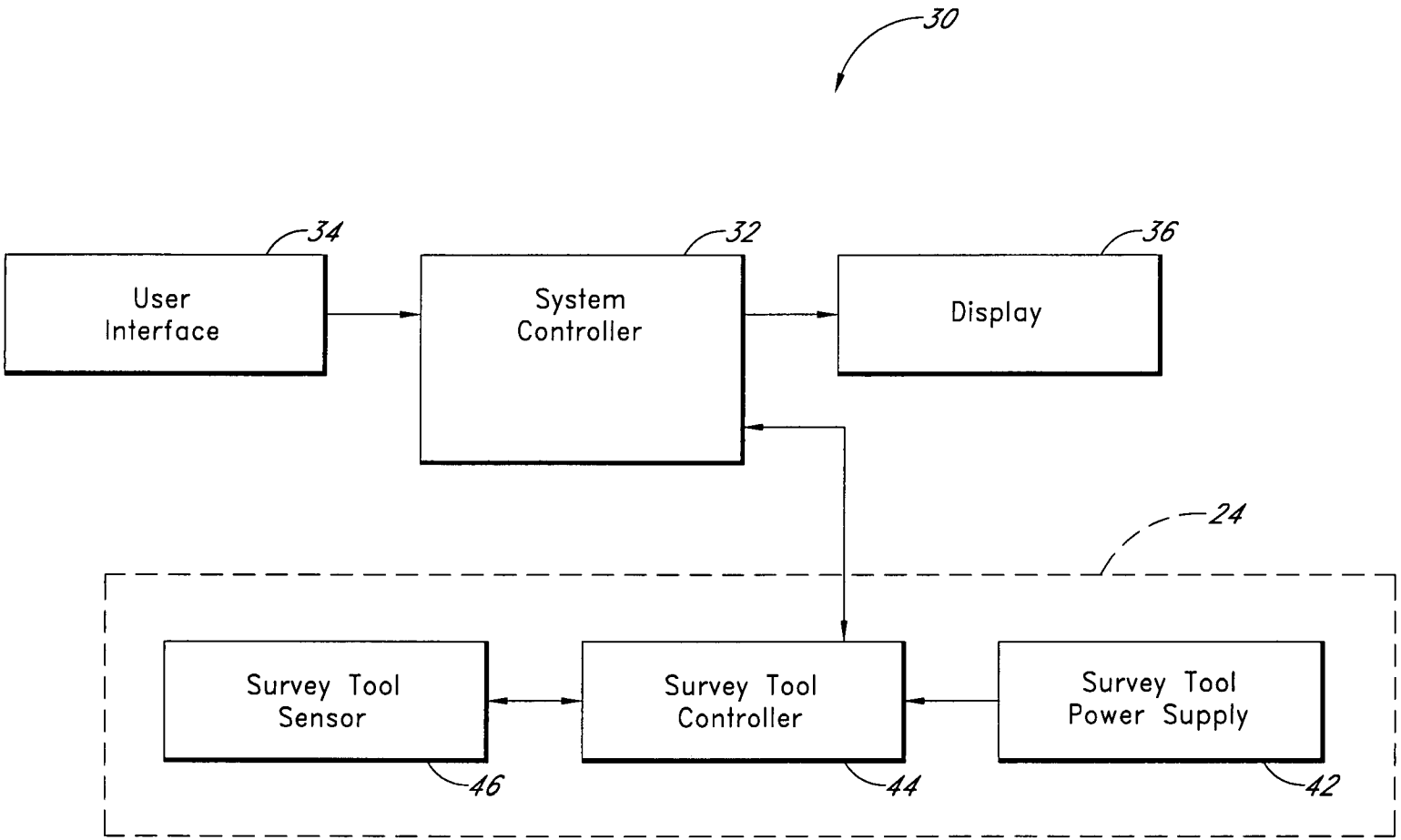
FIG. 2 schematically illustrates an embodiment of a MWD survey system in accordance with embodiments described herein.

FIG. 2 schematically illustrates an embodiment of a MWD survey system 30 in accordance with embodiments described herein. The MWD survey system 30 comprises a system controller 32, a user interface 34, a display 36, and the MWD survey tool 24. The system controller 32 is coupled to the user interface 34, the display 36, and the MWD survey tool 24. The system controller 32 comprises a microprocessor and is configured to receive user input signals from the user interface 34 and to transmit output, signals to the display 36. In such embodiments, the system controller 32 comprises appropriate interfaces (e.g., modems) to transmit control signals to the MWD survey tool 24, and to receive data signals from the MWD survey tool 24. In certain embodiments, the MWD survey system 30 is configured to be coupled to a computer dedicated to the control of the drilling system 10. In other embodiments, some or all of the components of the MWD survey system 30 can be components of such a drilling system controller.

The user interface 34 of the MWD survey system 30 can comprise standard communication components (e.g., keyboard, mouse, toggle switches) for transmitting user input to the system controller 32. The display 36 of the MWD survey system 30 can comprise standard communication components (e.g., cathode-ray tube ("CRT") screen, alphanumeric meters) for displaying and/or recording operation parameters, drilling tool orientation and/or location coordinates, or other information from the system controller 32.

As schematically illustrated by FIG. 2, the MWD survey tool 24 comprises a survey tool power supply 42, a survey tool controller 44, and a survey tool sensor 46. The survey tool sensor 46 resides within the borehole 14 as part of the drilling tool 20. The survey tool power supply 42 and the survey tool controller 44 also preferably reside within the borehole 14 as part of the drilling tool 20. While FIG. 2 shows the components of the MWD survey tool 24 as being separate from one another, other embodiments can include two or more components as a single unit.

The system controller 32 is configured to transmit control signals to the survey tool controller 44 and to receive data signals from the MWD survey tool 24. In certain embodiments, the survey tool controller 44 toggles between selected operating conditions in response to the control signals from the system controller 32. For example, in certain embodiments, the survey tool controller 44 toggles between two or more resolution modes in response to the control signals from the system controller 32. The system controller 32 can generate the control signals in response to the user input, or in response to input from other components of the drilling system 10 (e.g., the MWD survey tool 24 itself). The system controller 32 transmits the control signals to the survey tool controller 44 so as to set various operation parameters for the MWD survey tool 24.

The system controller 32 uses the data signals from the survey tool sensor 46 to calculate the orientation and/or the position of the drilling tool 20. The system controller 32 can also use the data signals from the survey tool sensor 46 to determine appropriate operation parameters for the MWD survey system 30. In certain embodiments in which the system controller 32 comprises a digital signal processor, the system controller 32 further comprises random-access memory ("RAM") (e.g., 16 KB, 32 KB, or 64 KB) in which data are represented as digital data words (e.g., 8-bit, 16-bit, or 32-bit words) which can be scaled so as to provide a plurality of resolution levels. In certain such embodiments, the MWD survey system 30 is operable at a plurality of resolution levels, and the survey tool sensor 46 is configured to provide data signals having a selected resolution level. As used herein, the term "resolution level" refers to the resolution of the digital representation of the data of the MWD survey system 30.

The resolution level and the data range of values vary inversely to one another. The resolution level is increased by rescaling while decreasing the data range corresponding to a single bit of the data word. For example, in a first resolution level, a range of data values of 0 to 32,000 can be scaled to correspond to a data word of 16 bits, so that the data word has a resolution of 2000/bit (32,000/16 bits). By resealing so that a range of data values of 0–16,000 corresponds to the 16-bit data word in a second resolution level, the resolution of the data word is 1000/bit (16,000/16 bits). The second resolution level of this example is higher than the first resolution level by a factor of two, while having a range of data values which is reduced by a factor of two. Thus, there is a tradeoff between the resolution and the range of data values corresponding to the data word. In embodiments in which the survey tool sensor 46 comprises a gyroscopic sensor, the resolution level can be expressed as a range of rotation rates (i.e., degrees or radians per unit time) corresponding to the data word.

In certain embodiments, the survey tool controller 44 is configured to toggle between a "standard resolution mode" and a "rescaled resolution mode." In the standard resolution mode, the full range of data values of the data word corresponds generally to the magnitude of Earth's rotation rate (approximately 15 degrees/hour). In certain such embodiments, the full range of data values for the standard resolution mode is approximately ±24 degrees/hour, so that the resolution of a 16-bit data word is approximately 3 degrees/hour/bit. In the rescaled resolution mode, the full range of data values of the data word is significantly higher than the magnitude of Earth's rotation rate, and is selected to avoid saturation due to motion of the MWD survey tool 24. In certain such embodiments, the full range of data values for the rescaled resolution mode is approximately ±200 degrees/hour, so that the resolution of a 16-bit data word is approximately 25 degrees/hour/bit. In certain embodiments, the rescaled resolution mode also includes an increase of the sampling rate of the data from the survey tool sensor 36. Thus, by decreasing the resolution of the measurements, the rescaled resolution mode provides a non-saturated measurement of the rotation rate of the MWD survey tool 24.

In certain embodiments in which the survey tool power supply 42 is within the MWD survey tool 24, the survey tool power supply 42 comprises a battery. In other such embodiments, the survey tool power supply 42 comprises a turbine which generates power from the flowing drilling fluid. Other forms of power supplies are compatible with embodiments described herein.

In certain embodiments, the drilling fluid provides a conduit for propagation of pressure signals which serve as the control and data signals between the system controller 32 and the MWD survey tool 24. In other embodiments, the drilling assembly 10, including the drill string 15, provides a conduit for propagation of acoustic control and data signals between the system controller 32 and the MWD survey tool 24. In still other embodiments, the survey tool controller 44 comprises a modem for transmitting data signals to, and receiving control signals from, the system controller 32.

The survey tool controller 44 is also configured to provide appropriate power and control signals to the survey tool sensor 46, and to receive various data signals from the survey tool sensor 46. The survey tool controller 44 can comprise a power module for generating the power and control signals and a data module for receiving the data signals. In certain embodiments, the survey tool controller 44 uses the data signals from the survey tool sensor 46 to monitor the operation of the survey tool sensor 46 and to appropriately modify the control signals (e.g., as part of a feedback system) transmitted to the survey tool sensor 46 so as to maintain the desired operation parameters of the survey tool sensor 46.

As described above, in certain embodiments, the survey tool sensor 46 comprises a gyroscopic sensor, which can be a rate gyroscope that generates data signals indicative of the orientation of the rate gyroscope relative to the Earth's rotation axis (i.e., azimuth relative to true north). In certain other embodiments, the survey tool sensor 46 comprises one or more accelerometers configured to sense the components of the gravity vector. In certain embodiments, two or more single-axis accelerometers are used, while in other embodiments, one or more two-axis or three-axis accelerometers are used. The data signals produced by such an accelerometer are indicative of the orientation of the accelerometer relative to the direction of Earth's gravity (i.e., the inclination of the survey tool sensor 46 from the vertical direction). In still other embodiments, the survey tool sensor 46 comprises a magnetometer configured to sense the magnitude and direction of the Earth's magnetic field. The data signals produced by such a magnetometer are indicative of the orientation of the magnetometer relative to the Earth's magnetic field (i.e., azimuth relative to magnetic north). An exemplary magnetometer compatible with embodiments described herein is available from General Electric Company of Schenectady, N.Y. Various embodiments of the survey tool sensor 46 can comprise one or more of the above-described types of sensors.

Figure 3:
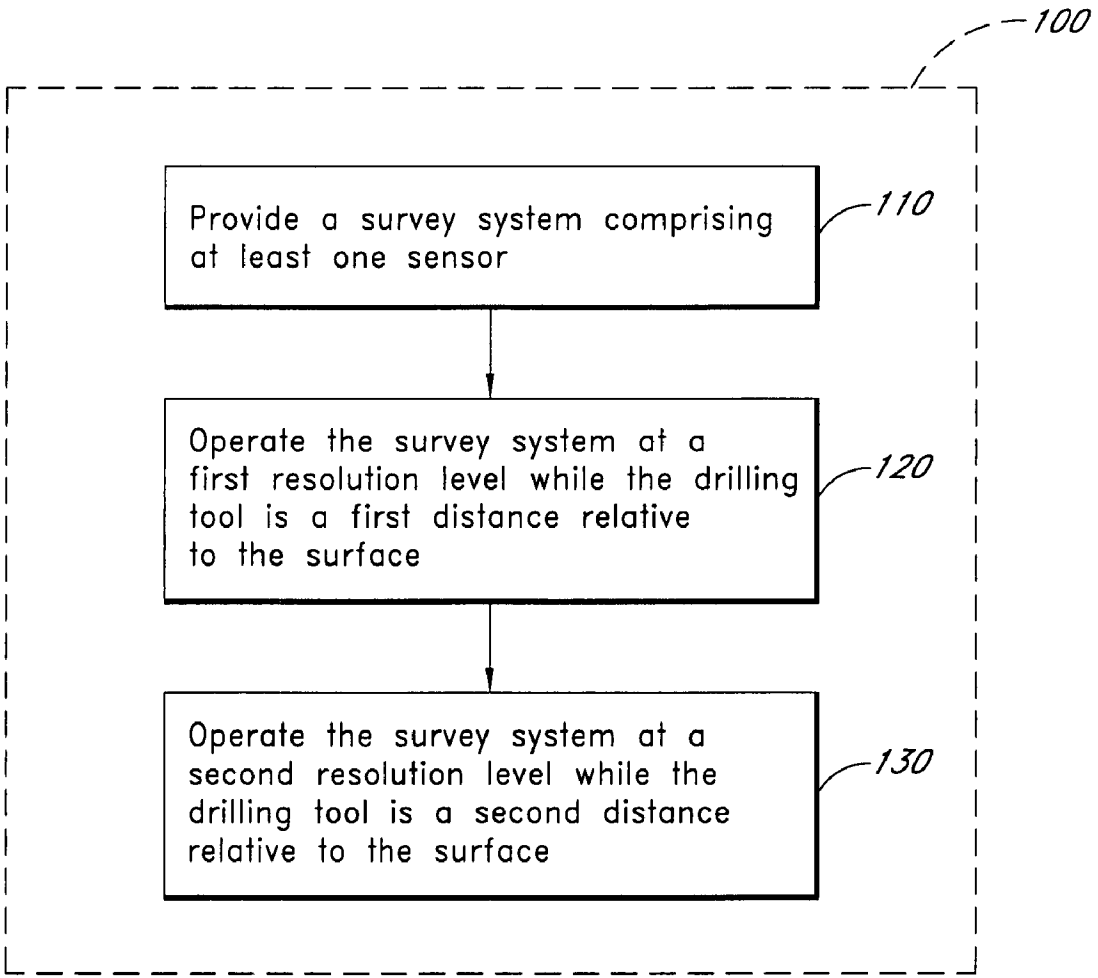
FIG. 3 is a flow diagram of an embodiment of a method for determining an orientation of a drilling tool of a drilling system configured to drill a borehole into the Earth's surface.

FIG. 3 is a flow diagram of an embodiment of a method 100 for determining an orientation of a drilling tool 20 of a drilling system 10 configured to drill a borehole 14 into the Earth's surface 12. While the method 100 is described below in reference to the drilling system 10, drilling tool 20, and MWD survey system 30 described above, other systems and devices are compatible with embodiments of the methods described herein.

The method 100 comprises providing a MWD survey system 30 comprising at least one sensor 46 within the drilling system 10 in an operational block 110. The sensor 46 is configured to provide orientation information, and the MWD survey system 30 is operable at a plurality of resolution levels. The method 100 further comprises operating the MWD survey system 30 in a first resolution level while the drilling tool 20 is a first distance relative to the surface 12 in an operational block 120. The method 100 further comprises operating the MWD survey system 30 in a second resolution level while the drilling tool 20 is a second distance relative to the surface 12 in an operational block 130. The second distance is larger than the first distance, and the second resolution level is higher than the first resolution level.

In certain embodiments, the MWD survey system 30 provided in the operational block 110 comprises a sensor 46 configured to provide orientation information. Alternatively, the sensor 46 is configured to provide location information. In other embodiments, the MWD survey system 30 comprises a plurality of sensors 46 within the drilling system 10 which are configured to provide orientation information and/or location information. The sensor 46 preferably comprises a gyroscopic sensor, but in other embodiments, the sensor 46 can comprise an accelerometer or a magnetometer.

Certain embodiments of the MWD survey system 30 can comprise a mixture of sensor types (e.g., gyroscopes, accelerometers, and magnetometers).

Figure 4A:
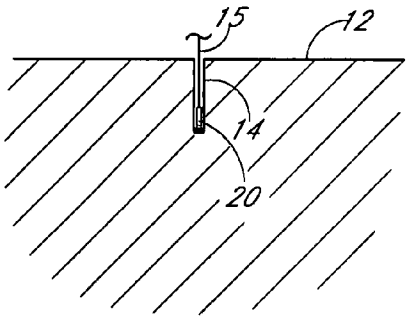
FIGS. 4A–C schematically illustrate a drilling tool at various distances relative to the surface, where the drilling system is operated at a plurality of resolution levels.

The MWD survey system 30 is operable at a plurality of resolution levels, and the MWD survey system 30 is operated at a first resolution level while the drilling tool 20 is a first distance relative to the surface 12 in the operational block 120. As schematically illustrated in FIG. 4A, in certain embodiments, the MWD survey system 30 is operated at the first resolution level when the drilling tool 20 has begun drilling and is in proximity to the surface 12. Measurements using the MWD survey system 30 can begin when the drilling tool 20 is above the surface 12 prior to drilling. In such embodiments, the measurements above the surface 12 can be performed at the first resolution level. Once drilling has proceeded to between approximately 30 to approximately 90 feet below the surface 12, additional measurements at the first resolution level can be made.

Figure 4B:
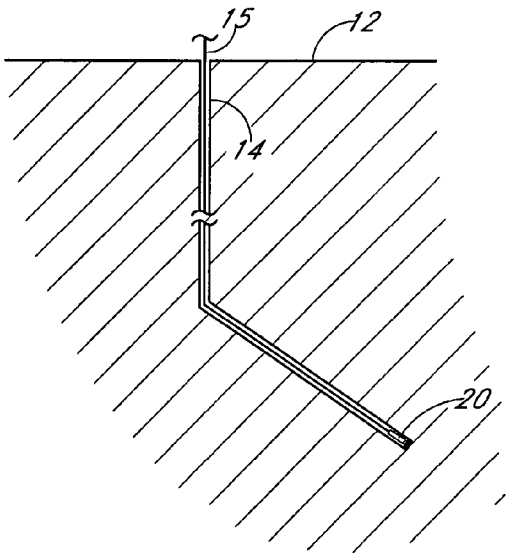
Figure 4C:
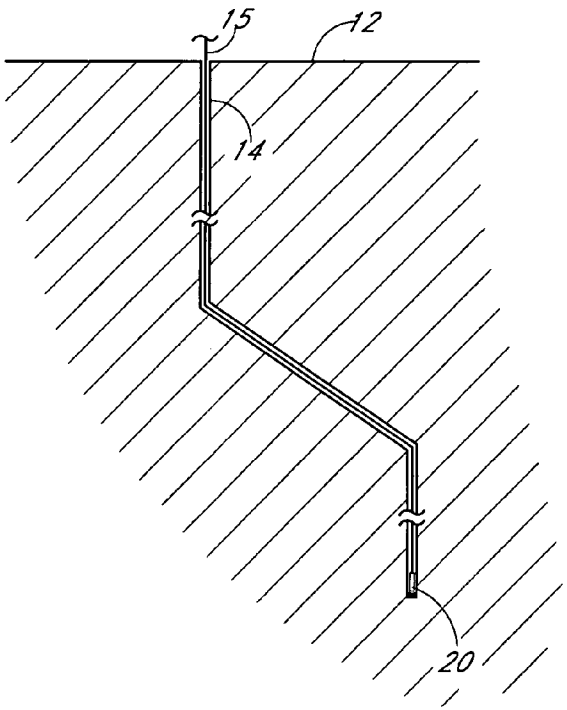

The MWD survey system 30 is operated at a second resolution level while the drilling tool 20 is a second distance relative to the surface 12 in the operational block 130. As schematically illustrated in FIG. 4B, in certain embodiments, the MWD survey system 30 is operated at the second resolution level when second distance is greater than the first distance (i.e., when the drilling tool 20 is further from the surface 12). As schematically illustrated in FIG. 4C, in certain embodiments, the MWD survey system 30 is operated at a third resolution level while the drilling tool 20 is a third distance relative to the surface 12, the third distance being greater than the second distance. The various distances correspond to different environments in which the data signals from the survey tool sensor 46 are advantageously rescaled to optimize the resolution of the data signals.

In certain embodiments, the survey tool sensor 46 is configured to operate in the first resolution level while at a first position relative to a surface location and to operate in the second resolution level higher than the first resolution level while at a second position relative to the surface location. In certain embodiments, the surface location is a surface opening location of the borehole 14. As used herein, the term "surface opening location" refers to the location where the borehole 14 intersects the surface 12.

In certain such embodiments, the first position and the second position are both above the surface location and the second position is closer to the surface location than is the first position. In other such embodiments, the first position is above the surface location and the second position is below the surface location. In still other such embodiments, the first position and the second position are both below the surface location and the second position is farther from the surface location than is the first position.

In certain embodiments, the survey tool sensor 46 is further configured to operate in a third resolution level higher than the second resolution level while at a third position relative to the surface location. In certain such embodiments, the second position and the third position are both below the surface location and the third position is further below the surface location than is the second position.

In certain embodiments, the survey tool sensor 46 is configured to operate in the first resolution level while the borehole 14 has a depth less than a predetermined depth. The survey tool sensor 46 is also configured to operate in the second resolution level while the borehole 14 has a depth greater than the predetermined depth. In certain embodiments, the length of the drill string 15 is used as a measure of the depth of the borehole 14, such that the first resolution level is used when the drill string 15 has a length less than a predetermined length and the second resolution level is used when the drill string 15 has a length greater than the predetermined length.

In embodiments in which the survey tool sensor 46 comprises a gyroscopic sensor sensitive to the Earth's rotation, the various resolution levels are selected to optimize the accuracy of the rate calculations in light of the attenuating noise contribution as the drilling tool 20 extends further down from the surface 12. In certain embodiments, the resolution levels are pre-programmed into the drilling system 10, while in other embodiments, the resolution levels are adjusted automatically in response to user input or in response to the data signals from the survey tool sensor 46.

In certain embodiments, the first resolution level from the survey tool sensor 46 comprising a gyroscopic sensor preferably has a corresponding range of rotation rate measurements of approximately zero to approximately 3600 degrees/hour (i.e., approximately one degree/second) for the data word, and the second resolution level preferably has a corresponding range of rotation rate measurements of approximately zero to approximately 15 degrees/hour (i.e., approximately 0.0042 degrees/second) for the data word. This preferred second resolution level corresponds to the rotation rate of the Earth, and is termed "earth rate calibration" of the MWD survey system 30. In certain embodiments utilizing a third resolution level, the second resolution level preferably has a corresponding range of rotation rate measurements of approximately zero to approximately 200 degrees/hour (i.e., approximately 0.056 degrees/second) for the data word, and the third resolution level preferably has a corresponding range of rotation rate measurements of approximately zero to approximately the rotation rate of the Earth (i.e., approximately 15 degrees/hour or 0.0042 degrees/second) for the data word. Other ranges for the various resolution levels are compatible with embodiments described herein.

Various techniques can be used to determine when to operate the drilling system 10 at each of the plurality of resolution levels, and what resolution levels to use. In certain embodiments, the resolution level is changed in response to user input provided to the system controller 32 via the user interface 34. In other embodiments, the resolution level determinations are made by the MWD survey system 30 itself automatically. In certain such embodiments, the determinations can be made by the system controller 32 which sends appropriate control signals to the survey tool controller 44 within the borehole 14. The survey tool controller 44 then sends appropriate control signals to the survey tool sensor 46. In other such embodiments, the determinations can be made by the survey tool controller 44.

In certain embodiments, the determinations of the resolution levels to be used are made based on the linear depth of the borehole 14. For example, a first resolution level can be used for borehole depths of approximately zero to approximately 1000 feet, and a second resolution level higher than the first resolution level can be used for borehole depths greater than approximately 1000 feet. In embodiments in which a third resolution level is used with the third resolution level higher than the second resolution level, the second resolution level can be used for borehole depths between approximately 100 feet and approximately 1000 feet, and the third resolution level can be used for borehole depths above approximately 1000 feet. Other borehole depths are compatible with embodiments described herein.

In certain embodiments, the resolution level determinations are based on other parameters of the pathway of the borehole 14 monitored by the MWD survey system 30. For example, the determinations can be based on the inclination angle away from the vertical. For example, the first resolution level can be used for inclinations of approximately zero to approximately 5 degrees, and the second resolution level can be used for inclinations greater than approximately 5 degrees. In embodiments in which a third resolution level is used, the second resolution level can be used for inclinations between approximately 1 degree and approximately 5 degrees, and the third resolution level can be used for inclinations greater than approximately 5 degrees. Other inclinations are compatible with embodiments described herein.

Alternatively, the resolution level determination can be based on changes of the inclination of the drilling tool 20 for boreholes in which the inclination changes as a function of the borehole depth. For example, the first resolution level can be used at the start of the borehole 14 schematically illustrated in FIG. 4A in which the inclination is approximately zero. As the drilling tool 20 progresses, the inclination can become substantially non-zero, as schematically illustrated in FIG. 4B, and this change of inclination can trigger the use of the second resolution level. As the drilling tool 20 progresses further, the inclination can be approximately zero again, as schematically illustrated in FIG. 4C, and this change of inclination can trigger the use of the third resolution level. Other parameters of the borehole pathway (e.g., azimuth from true north) may be used to determine the appropriate resolution level to be used.

In certain embodiments, the resolution level determinations are based on characteristics of the data values being generated by the survey tool sensor 46. For example, the resolution level of the MWD survey system 30 can be changed in response to noise on the data signals from the survey tool sensor 46. The noise can be characterized in various ways, including but not limited to, the consistency among sequential measurements over a period of time, or the standard deviation of a series of sequential measurements over a period of time. In other embodiments, the resolution level of the MWD survey system 30 can be based on the magnitude of the data signals. For example, if the noise from a gyroscopic sensor saturates the resolution level being used (i.e., results in data signals greater than the full range of rotation rates for the data word), then the resolution level can be reduced by increasing the range of rotation rates for the data word until the data signals are fully within the range of the data word. In such embodiments, the MWD survey system 30 can change from the first resolution level to the second resolution level once the magnitude of the data signal does not saturate the corresponding data word.

In certain embodiments, the drilling system 10 calculates a time-averaged measurement from a plurality of measurements from the survey tool sensor 46. By averaging the measurements from the survey tool sensor 46 over a time window, such time-averaged measurements can substantially average out the noise on the measurements from the survey tool sensor 46. The time window is preferably long compared to the phenomenon creating the noise (e.g., ocean waves impinging the drilling assembly). This time window can preferably be adjusted to provide sufficient averaging to substantially reduce the noise contribution to the time-averaged measurement. Other forms of noise-reducing filtering are also compatible with embodiments described herein.

Such filtering sacrifices some amount of accuracy, but provides usable measurements of the orientation and/or location of the drilling tool 20 near the surface 12. In addition, the lower accuracy of measurements near the surface 12 is of less importance because near the surface 12, the borehole 14 is typically close to vertical. In such embodiments, the accuracy of the azimuthal measurement does not appreciably affect the determination of the location of the drilling tool 20.

Various embodiments of the present invention have been described above. Although this invention has been described with reference to these specific embodiments, the descriptions are intended to be illustrative of the invention and are not intended to be limiting. Various modifications and applications may occur to those skilled in the art without departing from the true spirit and scope of the invention as defined in the appended claims.

What is claimed is:

1. A method for determining an orientation of a drilling tool of a drilling system configured to drill a borehole into the Earth's surface, the method comprising:

providing a survey system comprising at least one sensor within the drilling system, the survey system operable to provide information regarding the orientation of the drilling tool relative to the Earth at a plurality of resolution levels;

operating the survey system to provide information regarding the orientation of the drilling tool relative to the Earth at a first resolution level while the drilling tool is a first distance relative to the surface; and operating the survey system to provide information regarding the orientation of the drilling tool relative to the Earth at a second resolution level while the drilling tool is a second distance relative to the surface, the second distance larger than the first distance, the second resolution level higher than the first resolution level.

2. The method of claim 1, wherein the sensor comprises a gyroscopic sensor.

3. The method of claim 1, further comprising operating the survey system to provide information regarding the orientation of the drilling tool relative to the Earth at a third resolution level while the drilling tool is a third distance relative to the surface, the third distance larger than the second distance, the third resolution level higher than the second resolution level.

4. The method of claim 1, wherein the method further comprises monitoring a linear depth of the drilling tool down the borehole, and changing from the first resolution level to the second resolution level when the linear depth is approximately equal to a predetermined value.

5. The method of claim 1, wherein the method further comprises monitoring a depth of the borehole, and changing from the first resolution level to the second resolution level when the depth of the borehole is approximately equal to a predetermined value.

6. The method of claim 1, wherein the method further comprises monitoring an inclination angle of the drilling tool, and changing from the first resolution level to the second resolution level when the inclination angle is approximately equal to a predetermined value.

7. The method of claim 1, wherein the method further comprises monitoring a change of an inclination angle of the drilling tool as the drilling tool progresses down the borehole, and changing from the first resolution level to the second resolution level when the change of the inclination angle is approximately equal to a predetermined value.

8. The method of claim 1, further comprising changing from the first resolution level to the second resolution level in response to user input.

9. The method of claim 1, further comprising changing from the first resolution level to the second resolution level in response to a data signal from the sensor.

10. The method of claim 9, wherein changing from the first resolution level to the second resolution level is performed in response to noise on the data signal from the sensor.

11. A method for determining an orientation of a drilling tool of a drilling system configured to drill a borehole into the Earth's surface, the method comprising:

providing a survey system comprising at least one sensor within the drilling system, wherein the sensor comprises a gyroscopic sensor and is configured to provide orientation information, the survey system operable at a plurality of resolution levels;

operating the survey system at a first resolution level while the drilling tool is a first distance relative to the surface, wherein the first resolution level has a corresponding range of rotation rate measurements of approximately zero to approximately 3600 degrees/hour; and operating the survey system at a second resolution level while the drilling tool is a second distance relative to the surface, the second distance larger than the first distance, the second resolution level higher than the first resolution level.

12. The method of claim 11, wherein the second resolution level has a corresponding range of rotation rate measurements of approximately zero to approximately 15 degrees/hour.

13. The method of claim 11, wherein the second resolution level has a corresponding range of rotation rate measurements of approximately zero to approximately 200 degrees/hour.

14. A method for determining an orientation of a drilling tool of a drilling system configured to drill a borehole into the Earth's surface, the method comprising:

providing a survey system comprising at least one sensor within the drilling system, wherein the sensor comprises a gyroscopic sensor and is configured to provide orientation information, the survey system operable at a plurality of resolution levels;

operating the survey system at a first resolution level while the drilling tool is a first distance relative to the surface, wherein the first resolution level has a corresponding range of rotation rate measurements of approximately zero to approximately 3600 degrees/hour;

operating the survey system at a second resolution level while the drilling tool is a second distance relative to the surface, the second distance larger than the first distance, the second resolution level higher than the first resolution level, wherein the second resolution level has a corresponding range of rotation rate measurements of approximately zero to approximately 200 degrees/hour; and operating the survey system at a third resolution level while the drilling tool is a third distance relative to the surface, the third distance larger than the second distance, the third resolution level higher than the second resolution level, wherein the third resolution level has a corresponding range of rotation rate measurements of approximately zero to approximately 15 degrees/hour.

15. A method for determining an orientation of a drilling tool of a drilling system configured to drill a borehole into the Earth's surface, the method comprising:

providing a survey system comprising at least one sensor within the drilling system, the sensor configured to provide orientation information, the survey system operable at a plurality of resolution levels;

operating the survey system at a first resolution level while the drilling tool is a first distance relative to the surface;

operating the survey system at a second resolution level while the drilling tool is a second distance relative to the surface, the second distance larger than the first distance, the second resolution level higher than the first resolution level; and changing from the first resolution level to the second resolution level in response to a data signal from the sensor, wherein changing from the first resolution level to the second resolution level is performed once a magnitude of the data signal does not saturate a corresponding data word.

16. A method for determining a location of a drilling tool of a drilling system configured to drill a borehole into the Earth's surface, the method comprising:

providing a survey system comprising at least one sensor within the drilling system, the survey system operable to provide information regarding the orientation of the drilling tool relative to the Earth at a plurality of resolution levels;

operating the survey system to provide information regarding the orientation of the drilling tool relative to the Earth at a first resolution level while the drilling tool is a first distance relative to the surface;

operating the survey system to provide information regarding the orientation of the drilling tool relative to the Earth at a second resolution level while the drilling tool is a second distance relative to the surface, the second distance larger than the first distance, the second resolution level higher than the first resolution level; and calculating the location of the drilling tool using the information provided at the first resolution level and the information provided at the second resolution level.

17. The method of claim 16, wherein the sensor comprises a gyroscopic sensor.

18. The method of claim 16, further comprising operating the survey system to provide information regarding the orientation of the drilling tool relative to the Earth at a third resolution level while the drilling tool is a third distance relative to the surface, the third distance larger than the second distance, the third resolution level higher than the second resolution level.

19. A method for determining either an orientation or a location of a drilling tool of a drilling system configured to drill a borehole into the Earth's surface, the method comprising:

providing a survey system comprising at least one sensor within the drilling system, the survey system operable to provide information regarding the orientation of the drilling tool relative to the Earth at a plurality of resolution levels;

operating the survey system to provide information regarding the orientation of the drilling tool relative to the Earth at a first resolution level while the drilling tool is at a first location relative to the surface;

operating the survey system to provide information regarding the orientation of the drilling tool relative to the Earth at a second resolution level while the drilling tool is at a second location relative to the surface, the second location farther from the surface than is the first location, the second resolution level higher than the first resolution level; and calculating the orientation or the location of the drilling tool using the orientation information provided at the first resolution level and the orientation information provided at the second resolution level.

20. The method of claim 19, wherein the sensor comprises a gyroscopic sensor.

21. The method of claim 19, further comprising operating the survey system to provide information regarding the orientation of the drilling tool relative to the Earth at a third resolution level while the drilling tool is at a third location relative to the surface, the third location farther from the surface than is the second location, the third resolution level higher than the second resolution level.

22. A method of operating a sensor of a system for drilling a borehole, the method comprising:

configuring the sensor to provide information having a first resolution level regarding the orientation of the drilling tool relative to the Earth, the information having the first resolution level provided while the sensor is at a first position relative to a surface location; and configuring the sensor to provide information having a second resolution level regarding the orientation of the drilling tool relative to the Earth, the second resolution level higher than the first resolution level, the information having the second resolution level provided while the sensor is at a second position relative to the surface location.

23. The method of claim 22, wherein the surface location is a surface opening location of the borehole.

24. The method of claim 22, wherein the first position and the second position are both above the surface location and the second position is closer to the surface location than is the first position.

25. The method of claim 22, wherein the first position is above the surface location and the second position is below the surface location.

26. The method of claim 22, wherein the first position and the second position are both below the surface location and the second position is farther from the surface location than is the first position.

27. The method of claim 22, wherein the sensor comprises a gyroscopic sensor.

28. The method of claim 22, further comprising changing from the first resolution level to the second resolution level in response to user input.

29. The method of claim 22, further comprising changing from the first resolution level to the second resolution level in response to a data signal from the sensor.

30. The method of claim 22, further comprising configuring the sensor to provide information having a third resolution level regarding the orientation of the drilling tool relative to the Earth, the third resolution level higher than the second resolution level, the information having the third resolution level provided while the sensor is at a third position relative to the surface location.

31. The method of claim 30, wherein the second position and the third position are both below the surface location and the third position is further below the surface borehole location than is the second position.

32. A method of operating a sensor of a drilling system comprising a drill string, the method comprising:

configuring the sensor to provide orientation information having a first resolution level while the drill string has a length less than a predetermined length; and configuring the sensor to provide orientation information having a second resolution level higher than the first resolution level while the drill string has a length greater than the predetermined length.

33. A drilling system for drilling a borehole into the Earth's surface, the system comprising:

a drilling tool; and a survey system configured to be operable to provide information regarding the orientation of the drilling tool relative to the Earth at a plurality of resolution levels, the survey system comprising:

at least one sensor within the drilling system, the sensor configured to provide information regarding the orientation of the drilling tool relative to the Earth; and a controller coupled to the sensor, the controller configured to operate to provide information regarding the orientation of the drilling tool relative to the Earth at a first resolution level while the drilling tool is a first distance relative to the surface and to operate to provide information regarding the orientation of the drilling tool relative to the Earth at a second resolution level while the drilling tool is a second distance relative to the surface, the second distance larger than the first distance, the second resolution level higher than the first resolution level.

34. The drilling system of claim 33, wherein the controller comprises a microprocessor within the drilling system.

* * * * *